US010266787B2

(12) United States Patent
Sekiguchi et al.

(10) Patent No.: US 10,266,787 B2
(45) Date of Patent: Apr. 23, 2019

(54) GREASE COMPOSITION

(71) Applicant: IDEMITSU KOSAN CO., LTD., Chiyoda-ku (JP)

(72) Inventors: Hiroki Sekiguchi, Ichihara (JP); Yukitoshi Fujinami, Ichihara (JP); Yusuke Nakanishi, Sodegaura (CN); Kouji Takane, Ichihara (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 14/433,979

(22) PCT Filed: Oct. 22, 2013

(86) PCT No.: PCT/JP2013/078508
§ 371 (c)(1),
(2) Date: Apr. 7, 2015

(87) PCT Pub. No.: WO2014/077090
PCT Pub. Date: May 22, 2014

(65) Prior Publication Data

US 2015/0252283 A1 Sep. 10, 2015

(30) Foreign Application Priority Data

Nov. 16, 2012 (JP) ..... 2012-252727

(51) Int. Cl.
*C10M 173/02* (2006.01)
*C10M 169/04* (2006.01)
*C10M 169/06* (2006.01)

(52) U.S. Cl.
CPC ..... *C10M 169/04* (2013.01); *C10M 169/06* (2013.01); *C10M 2207/1276* (2013.01); *C10M 2207/1285* (2013.01); *C10M 2215/064* (2013.01); *C10M 2215/1026* (2013.01); *C10M 2219/044* (2013.01); *C10M 2219/046* (2013.01); *C10N 2220/022* (2013.01); *C10N 2230/06* (2013.01); *C10N 2230/08* (2013.01); *C10N 2230/52* (2013.01); *C10N 2240/04* (2013.01); *C10N 2250/10* (2013.01)

(58) Field of Classification Search
CPC ..... C10M 115/10; C10M 2227/06; C10M 2201/084
USPC ..... 508/179
See application file for complete search history.

(56) References Cited

U.S. PATENT DOCUMENTS

| | | | | |
|---|---|---|---|---|
| 7,294,608 | B2 * | 12/2007 | Oldiges | 508/390 |
| 2003/0176298 | A1 * | 9/2003 | Nakatani | C10M 123/06 508/398 |
| 2011/0021391 | A1 * | 1/2011 | E | C10M 169/00 508/165 |
| 2011/0111995 | A1 | 5/2011 | Akita et al. | |
| 2011/0183876 | A1 * | 7/2011 | Imai | C10M 169/06 508/100 |

FOREIGN PATENT DOCUMENTS

| | | | |
|---|---|---|---|
| CN | 102165052 | A | 8/2011 |
| CN | 102268323 | A | 12/2011 |
| EP | 2 348 094 | A1 | 7/2011 |
| JP | 2000-87071 | | 3/2000 |
| JP | 2003-301190 | A | 10/2003 |
| JP | 2004-269789 | A | 9/2004 |
| JP | 2006-335286 | A | 12/2006 |
| JP | 2007-084620 | A | 4/2007 |
| JP | 2007-530732 | A | 11/2007 |
| JP | 2008-271791 | A | 11/2008 |
| JP | 2009-114293 | A | 5/2009 |
| JP | 2010-031123 | A | 2/2010 |
| JP | 2010-77320 | A | 4/2010 |
| JP | 2011-111569 | A | 6/2011 |
| JP | 2012-193298 | A | 10/2012 |

OTHER PUBLICATIONS

International Search Report dated Nov. 19, 2013 in PCT/JP2013/078508 filed Oct. 22, 2013.
Extended European Search Report dated May 13, 2016 in Patent Application No. 13856042.0.
Combined Chinese Office Action and Search Report dated Aug. 29, 2016 in Patent Application 201380059856.X with partial English translation and English translation of category of cited documents.
Notice of Reason(s) for Rejection dated Apr. 4, 2017, in Japanese Patent Application No. 2014-546915 filed Oct. 22, 2013 (with English translation).
Second Notification of Examiner's Opinion dated Jun. 7, 2017, in Chinese Patent Application No. 201380059856.X filed Oct. 22, 2013 (with English translation).
Office Action dated Apr. 18, 2018 in Indonesian Patent Application No. P00201502768 (with English language translation), 4 pages.

* cited by examiner

*Primary Examiner* — Prem C Singh
*Assistant Examiner* — Francis C Campanell
(74) *Attorney, Agent, or Firm* — Oblon, McClelland, Maier & Neustadt, L.L.P.

(57) ABSTRACT

A grease composition contains a calcium sulfonate complex grease and an additive. The additive includes an overbased metal sulfonate and an antioxidant. The overbased metal sulfonate is preferably an overbased calcium sulfonate. The antioxidant is preferably an aminic antioxidant.

12 Claims, No Drawings

GREASE COMPOSITION

TECHNICAL FIELD

The present invention relates to a grease composition.

BACKGROUND ART

A calcium sulfonate complex grease is excellent in heat resistance and water resistance and is thus often applied to a sliding part around an automobile engine, a bearing of a rolling machine or the like for iron and steel, and outdoor gear (see, for instance, Patent Literatures 1 and 2).

Such a calcium sulfonate complex grease is a metal soap grease made of a metal complex soap, which is excellent in lubricity but has a grease structure unlikely to be maintained for a long duration of time at a high temperature.

Accordingly, a grease composition containing a thickener containing organic bentonite and an auxiliary thickener component is suggested (see, for instance, Patent Literature 3). It is also disclosed that the auxiliary thickener component is a metal complex soap, polyurea, fluorocarbon resin, N-substituted terephthalamic acid metal salt or calcium sulfonate complex. According to Patent Literature 3, a mixture of the organic bentonite and the auxiliary thickener component is used as the thickener to provide a grease composition excellent in rust resistance, extreme pressure property, water resistance and lubrication life.

CITATION LIST

Patent Literature(s)

Patent Literature 1: JP-A-2010-031123
Patent Literature 2: JP-A-2007-084620
Patent Literature 3: JP-A-2004-269789

SUMMARY OF THE INVENTION

Problems to be Solved by the Invention

However, even the grease composition of Patent Literature 3 is not sufficient in terms of lubrication life in use under a high-temperature environment.

Accordingly, an object of the invention is to provide a grease composition exhibiting an excellent oxidation stability and having a long service life even in use under a high-temperature environment.

Means for Solving the Problems

According to an aspect of the invention, a grease composition contains: a calcium sulfonate complex grease; and an additive including an overbased metal sulfonate and an antioxidant.

In the above aspect, the overbased metal sulfonate is preferably an overbased alkaline earth metal sulfonate.

In the above aspect, the overbased metal sulfonate is preferably an overbased calcium sulfonate.

In the above aspect, the antioxidant is preferably an aminic antioxidant.

In the above aspect, a content of the overbased metal sulfonate and the antioxidant is preferably in a range from 0.2 mass % to 20 mass % of a total amount of the grease composition.

In the above aspect, the overbased metal sulfonate preferably has a base number of 100 mgKOH/g or more.

In the above aspect, a base oil of the calcium sulfonate complex grease is preferably a mineral oil with a kinematic viscosity at 40 degrees C. of 60 $mm^2/s$ or more.

In the above aspect, the grease composition preferably has a worked penetration in a range from 220 to 385.

In the above aspect, the grease composition is preferably used for any one of a gear device, a speed increasing gear, a speed reducer and a spline.

According to the above aspect of the invention, a grease composition exhibiting an excellent oxidation stability and having a long service life even in use under a high-temperature environment can be provided.

DESCRIPTION OF EMBODIMENT(S)

According to an exemplary embodiment of the invention, a grease composition is provided by blending a grease with an additive, the grease being a calcium sulfonate complex grease, the additive including an overbased metal sulfonate and an antioxidant. The exemplary embodiment of the invention will be described below in detail.

Grease

The grease for the grease composition according to the exemplary embodiment is a calcium sulfonate complex grease, which contains a base oil and a calcium sulfonate complex as a thickener.

Base Oil

The base oil is not particularly limited and thus may be a mineral oil or a synthetic oil for a typical grease composition. The above oils may be used alone or in combination.

The mineral oil may be prepared by an appropriate combination of the following purification processes: vacuum distillation, solvent deasphalting, solvent extraction, hydrocracking, solvent dewaxing, cleaning with sulfuric acid, clay purification, hydrorefming and the like.

The base oil of the calcium sulfonate complex grease is preferably the mineral oil. Further, the kinematic viscosity of the mineral oil at 40 degrees C. is preferably 60 $mm^2/s$ or more.

Examples of the synthetic oil include a hydrocarbon synthetic oil, ester oil and ether oil.

Examples of the hydrocarbon synthetic oil include normal paraffin, isoparaffin, polybutene, polyisobutylene, and olefin oligomers such as 1-decene oligomer and co-oligomer of 1-decene and ethylene.

When the hydrocarbon synthetic oil is an aromatic oil, examples thereof include alkylbenzenes such as monoalkylbenzene and dialkylbenzene, and alkylnaphthalenes such as monoalkylnaphthalene, dialkylnaphthalene and polyalkylnaphthalene.

When the synthetic oil is an ester oil, examples thereof include diester oils such as clibutyl sebacate, di-2-ethylhexyl sebacate, dioctyl adipate, diisodecyl adipate, ditridecyl adipate, ditridecyl glutarate and methyl/ acetyl ricinoleate, aromatic ester oils such as trioctyl trimellitate, tridecyl trimellitate and tetraoctyl pyromellitate, polyol ester oils such as trimethylol propane caprylate, trimethylol propane peralgonate, pentaerythritol-2-ethylhexanoate and pentaerythritol peralgonate, and complex ester oils (oligoesters of polyhydric alcohol and dibasic or monobasic mixed fatty acid).

When the synthetic oil is an ether oil, examples thereof include polyglycols such as polyethylene glycol, polypropylene glycol, polyethylene glycol monoether and polypropylene glycol monoether, and phenyl ether oils such as monoalkyl triphenyl ether, alkykliphenyl ether, dialkyldiphenyl ether, pentaphenyl ether, tetraphenyl ether, monoalkyl tetraphenyl ether and dialkyl tetraphenyl ether.

Calcium Sulfonate Complex

The calcium sulfonate complex used as the thickener is a combination of calcium sulfonate and a calcium salt (a calcium soap) selected from among, for instance, (i) calcium carbonate, (ii) higher fatty acid calcium salts such as calcium dibehenate, calcium distearate and calcium dihydroxystearate, (iii) lower fatty acid calcium salts such as calcium acetate and (iv) calcium borate. In particular, calcium sulfonate and calcium carbonate are preferably contained as essential components of the calcium sulfonate complex and blended with at least two calcium salts selected from the group consisting of calcium dibehenate, calcium distearate, calcium dihydroxystearate, calcium borate and calcium acetate. In view of thickening performance, the base number of calcium sulfonate is preferably in a range from 50 mgKOH/g to 500 mgKOH/g and more preferably in a range from 300 mgKOH/g to 500 mgKOH/g. Specifically, a dialkylbenzene calcium sulfonate salt is particularly preferable.

The content of the calcium sulfonate complex is not limited as long as the calcium sulfonate complex and the base oil in combination can form grease and remain in the form of grease, but is preferably in a range from 15 mass % to 60 mass % of the total amount of the grease. When the content is less than 15 mass %, the mixture is unlikely to remain in the form of grease, whereas when the content is more than 60 mass %, the resulting grease composition (described later) is unfavorably extremely hardened and thus does not exhibit a sufficient lubricity.

It should be noted that the calcium sulfonate complex may be independently synthesized and then dispersed in the base oil, or may be synthesized in the base oil to be dispersed in the base oil. In particular, the latter method relatively easily enables a desirable dispersion of the calcium sulfonate complex in the base oil, and is thus suitable for industrial manufacturing of the grease composition.

Additive

The grease composition according to the exemplary embodiment is provided by blending the calcium complex grease with the additive as described above. The additive includes an overbased metal sulfonate and an antioxidant.

The calcium complex grease exhibits an improved heat resistance due to a combination of a higher fatty acid and a lower fatty acid, but tends to be hardened with time or thermally hardened.

The grease composition according to the exemplary embodiment, which contains the calcium complex grease and the additive including the overbased metal sulfonate and the antioxidant, is restrained from being hardened in use under a high-temperature environment. Further, a combination of the calcium complex grease and the additive contributes to improving oxidation stability.

Overbased Metal Sulfonate

Metal sulfonate is a metal salt of a sulfonic acid. Examples of the sulfonic acid include aromatic petroleum sulfonic acid, alkyl sulfonic acid, aryl sulfonic acid and alkylaryl sulfonic acid, and more specific examples thereof include dodecylbenzene sulfonic acid, dilaurylcetylbenzene sulfonic acid, paraffin-wax-substituted benzene sulfonic acid, polyalkyl-substituted benzene sulfonic acid, polyisobutylene-substituted benzene sulfonic acid and naphthalene sulfonic acid.

Examples of the metal include a variety of metals such as lithium, sodium, calcium, magnesium and zinc. Among the above, an overbased alkaline earth metal sulfonate prepared with an alkaline earth metal is preferable and an overbased calcium sulfonate prepared with calcium is more preferable. Specifically, an overbased dialkylbenzene calcium sulfonate salt is particularly preferable.

The base number of the overbased metal sulfonate is preferably 100 mgKOH/g or more and more preferably 300 mgKOH/g or more, the base number being determined by a perchloric acid method according to JIS K-2501. When the base number of the overbased metal sulfonate is less than 100 mgKOH/g, an oxidation stabilizing effect is unlikely to be obtained.

One of the above examples of the overbased metal sulfonate may be used alone or, alternatively, a combination of two or more thereof may be used.

The blend ratio of the overbased metal sulfonate is preferably in a range from 0.1 mass % to 10 mass % and more preferably in a range from 1 mass % to 5 mass % of the total amount of the grease composition.

Antioxidant

Examples of the antioxidant include aminic antioxidant, phenolic antioxidant, sulfuric antioxidant and phosphorous antioxidant. One of the above examples may be used alone or, alternatively, two or more thereof may be used in combination.

Among the above, an aminic antioxidant is particularly preferable because a combination of the aminic antioxidant and the overbased metal sulfonate improves oxidation stability and the resulting composition is unlikely to be hardened in use under a high-temperature environment.

Examples of the aminic antioxidant include: monoalkyldiphenylamine compounds such as monooctyldiphenylamine and monononyldiphenylamine; dialkyldiphenylamine compounds such as 4,4'-dibutyldiphenylamine, 4,4'-dipentyldiphenylamine, 4,4'-dihexyldiphenylamine, 4,4'-diheptyldiphenylamine, 4,4'-dioctyldiphenylamine and 4,4'-dinonyldiphenylamine; polyalkyldiphenylamine compounds such as tetrabutyldiphenylamine, tetrahexyldiphenylamine, tetraoctyldiphenylamine and tetranonyldiphenylamine; and naphthylamine compounds such as alpha-naphthylamine, phenyl-alpha-naphthylamine, butylphenyl-alpha-naphthylamine, pentylphenyl-alpha-naphthylamine, hexylphenyl-alpha-naphthylamine, heptylphenyl-alpha-naphthylamine, octylphenyl-alpha-naphthylamine and nonylphenyl-alpha-naphthylamine.

Examples of the phenolic antioxidant include: monophenol compounds such as 2,6-di-tert-butyl-4-methylphenol and 2,6-di-tert-butyl-4-ethylphenol; and diphenol compounds such as 4,4'-methylenebis(2,6-di-tert-butylphenol) and 2,2'-methylenebis(4-ethyl-6-tert-butylphenol).

Examples of the sulfuric antioxidant include 2,6-di-tert-butyl-4-(4,6-bis(octylthio)-1,3,5-triazine-2-ylamino)phenol, thioterpene compounds such as a reactant of phosphorus pentasulfide and pinene, and dialkyl thiodipropionate such as dilauryl thiodipropionate and distearyl thiodipropionate.

Examples of the phosphorous antioxidant include triphenyl phosphite and diethyl[3,5-bis(1,1-dimethylethyl)-4-hydroxyphenyl]methylphosphonate.

The blend ratio of the antioxidant is preferably in a range from 0.1 mass % to 10 mass % and more preferably in a range from 1 mass % to 5 mass % of the total amount of the grease composition.

The blend ratio of the additive added to the grease composition according to the exemplary embodiment (the total blend ratio of the overbased metal sulfonate and the antioxidant) is preferably in a range from 0.2 mass % to 20 mass % and more preferably in a range from 2 mass % to 10 mass % of the total amount of the grease composition. When the blend ratio of the additive falls below 0.2 mass %, the effect is unlikely to be obtained. When the blend ratio exceeds 20 mass %, the effect is saturated and thus such an increase is economically inefficient.

The grease composition according to the exemplary embodiment may be further blended with a predetermined amount of other additives in addition to the overbased metal sulfonate and the antioxidant to be used in various applications. Examples of other additives include an oiliness agent, extreme pressure agent, detergent dispersant, viscosity index improver, rust inhibitor, metal deactivator and antifoaming agent. One of the above additives may be used alone or, alternatively, two or more thereof may be used in combination. It should be noted that the above grease composition may be directly used in some applications without being blended with any other additive.

Examples of the oiliness agent include: aliphatic alcohol; fatty acid compounds such as fatty acid and fatty acid metal salt; ester compounds such as polyol ester, sorbitan ester and glyceride; and amine compounds such as aliphatic amine. The blend ratio of the oiliness agent is preferably in a range from 0.1 mass % to 30 mass % and more preferably in a range from 0.5 mass % to 10 mass % of the total amount of the grease composition in view of blend effects thereof.

Examples of the extreme pressure agent include sulfuric extreme pressure agent, phosphorus extreme pressure agent, extreme pressure agent containing sulfur and metal and extreme pressure agent containing phosphorous and metal. One of the extreme pressure agents may be used alone or, alternatively, two or more thereof may be used in combination. Any extreme pressure agent may be used as long as at least one of sulfur atom and phosphorous atom is contained in the molecule and exhibits load bearing properties and antifriction properties. Examples of the extreme pressure agent containing sulfur in the molecule include: sulfurized fat and oil, sulfurized fatty acid, ester sulfide, olefin sulfide, dihydrocarbyl polysulfide, thiadiazole compound, alkylthiocarbamoyl compound, triazine compound, thioterpene compound, dialkyl thiodipropionate compound and the like.

Examples of the extreme pressure agent containing sulfur, phosphorous and metal include zinc dialkylthiocarbamate (Zn-DTC), molybdenum dialkylthiocarbamate (Mo-DTC), lead dialkylthiocarbamate, tin dialkylthiocarbamate, zinc dialkyldithiocarbamate (Zn-DTP), molybdenum dialkyldithiophosphate (Mo-DTP), sodium sulfonate, and calcium sulfonate. Representative examples of the extreme pressure agent containing phosphorous in the molecule include: phosphate such as tricresyl phosphate, tricresyl phosphate and the like, and amine salt thereof. The blend ratio of the extreme pressure agent is preferably in a range from 0.01 mass % to 30 mass % and more preferably in a range from 0.01 mass % to 10 mass % of the total amount of the grease composition in view of blend effects thereof and economic efficiency.

Examples of the detergent dispersant include metal sulfonate, metal salicylate, metal phenate and succinimide. The blend ratio of the detergent dispersant is preferably in a range from 0.1 mass % to 30 mass % and more preferably in a range from 0.5 mass % to 10 mass % of the total amount of the grease composition in view of blend effects thereof.

Examples of the viscosity index improver include polymethacrylate, dispersed polymethacrylate, olefin copolymer (e.g., ethylene-propylene copolymer), dispersed olefin copolymer, and styrene copolymer (e.g., styrene-diene copolymer hydride). The blend ratio of the viscosity index improver is preferably in a range from 0.1 mass % to 35 mass % and more preferably in a range from 0.3 mass % to 15 mass % of the total amount of the grease composition in view of blend effects thereof.

Examples of the rust inhibitor include alkyl succinic acid ester, sorbitan monoester, carboxylic metal soap, and alkanolamine such as alkylamine and monoisopropanolamine. The blend ratio of the rust inhibitor is preferably in a range from 0.01 mass % to 10 mass % and more preferably in a range from 0.05 mass % to 5 mass % of the total amount of the grease composition in view of blend effects thereof.

Examples of the metal deactivator include benzotriazole and thiadiazole. The blend ratio of the metal deactivator is preferably in a range from 0.01 mass % to 10 mass % and more preferably in a range from 0.01 mass % to 1 mass % of the total amount of the grease composition in view of blend effects thereof.

Examples of the antifoaming agent include methylsilicone oil, fluorosilicone oil and polyacrylate. The blend ratio of the antifoaming agent is preferably in a range of 0.0005 mass % to 0.01 mass % of the total amount of the grease composition in view of blend effects thereof.

Grease Composition

The worked penetration of the grease composition according to the exemplary embodiment is preferably in a range from 220 to 385 (according to JIS K2220.7). When the worked penetration is 220 or more, the grease is not hard and thus exhibits an excellent low-temperature start-up performance. On the other hand, when the worked penetration is 385 or less, the grease is not too soft and thus exhibits an excellent lubricity.

The grease composition according to the exemplary embodiment is preferably used for any one of a gear device, a speed increasing gear, a speed reducer and a spline.

EXAMPLES(S)

The invention will be described in further detail with reference to Examples and Comparatives, which by no means limit the scope of the invention.

Examples 1 to 4, Comparatives 1 to 4

Grease compositions of Examples 1 to 4 and Comparatives 1 to 4 were prepared as follows.

Preparation of Base Grease

Base Grease 1

Calcium sulfonate with a base number of 400 mgKOH/g (77 parts by weight), paraffin mineral oil with a kinematic viscosity at 40 degrees C. of 90 $mm^2/s$ (19 parts by weight), 12-hydroxystearic acid (3 parts by weight), azelaic acid (1 part by weight), isopropanol (2 parts by weight), and distilled water (5 parts by weight) were stirred in a container at 75 degrees C. for two hours. Subsequently, the container was heated to 160 degrees C. to distill and remove the isopropanol and the distilled water. The content remaining in the container was cooled to room temperature to prepare a calcium sulfonate complex grease. The prepared grease was referred to as a base grease 1. The blend ratios for preparing the base grease 1 are shown in Table 1.

Base Grease 2

Calcium sulfonate with a base number of 400 mgKOH/g (74 parts by weight), paraffin mineral oil with a kinematic viscosity at 40 degrees C. of 90 $mm^2/s$ (23 parts by weight), 12-hydroxystearic acid (2 parts by weight), acetic acid (1 part by weight), isopropanol (2 parts by weight), and distilled water (5 parts by weight) were stirred in a container at 75 degrees C. for two hours. Subsequently, the container was heated to 160 degrees C. to distill and remove the isopropanol and the distilled water. The content remaining in the container was cooled to room temperature to prepare a calcium sulfonate complex grease. The prepared grease was referred to as a base grease 2. The blend ratios for preparing the base grease 2 are shown in Table 1.

Base Grease 3

Calcium sulfonate with a base number of 500 mgKOH/g (42 parts by weight), paraffin mineral oil with a kinematic viscosity at 40 degrees C. of 90 $mm^2/s$ (53 parts by weight), 12-hydroxystearic acid (4 parts by weight), acetic acid (1 part by weight), isopropanol (2 parts by weight), and distilled water (5 parts by weight) were stirred in a container at 75 degrees C. for two hours. Subsequently, the container was heated to 160 degrees C. to distill and remove the isopropanol and the distilled water. The content remaining in the container was cooled to room temperature to prepare a calcium sulfonate complex grease. The prepared grease was referred to as a base grease 3. The blend ratios for preparing the base grease 3 are shown in Table 1.

Base Grease 4

Calcium sulfonate with a base number of 500 mgKOH/g (48 parts by weight), paraffin mineral oil with a kinematic viscosity at 40 degrees C. of 90 $mm^2/s$ (46 parts by weight), 12-hydroxystearic acid (4 parts by weight), azelaic acid (2 parts by weight), isopropanol (2 parts by weight), and distilled water (5 parts by weight) were stirred in a container at 75 degrees C. for two hours. Subsequently, the container was heated to 160 degrees C. to distill and remove the isopropanol and the distilled water. The content remaining in the container was cooled to room temperature to prepare a calcium sulfonate complex grease. The prepared grease was referred to as a base grease 4. The blend ratios for preparing the base grease 4 are shown in Table 1.

Base Grease 5

A paraffin mineral oil with a kinematic viscosity at 40 degrees C. of 90 $mm^2/s$ (77.2 parts by weight), 12-hydroxystearic acid (13.5 parts by weight), azelaic acid (5 parts by weight), lithium hydroxide monohydrate (4.3 parts by weight), and water (20 parts by weight) were stirred in a container at 95 degrees C. for two hours. Subsequently, the container was heated to 160 degrees C. to distill and remove the isopropanol and the distilled water. The content remaining in the container was cooled to room temperature to prepare a lithium complex grease. The prepared grease was referred to as a base grease 5. The blend ratios for preparing the base grease 5 are shown in Table 2.

Base Grease 6

A paraffin mineral oil with a kinematic viscosity at 40 degrees C. of 90 $mm^2/s$ (89.8 parts by weight), diphenylmethane-4,4'-diisocyanate (5.1 parts by weight), and octylamine (5.1 parts by weight) were stirred in a container at 75 degrees C. for two hours. Subsequently, the container was heated to 160 degrees C. The content remaining in the container was cooled to room temperature to prepare a urea grease. The prepared grease was referred to as a base grease 6. The blend ratios for preparing the base grease 6 are shown in Table 2.

TABLE 1

| | | | Base Grease 1 | Base Grease 2 | Base Grease 3 | Base Grease 4 |
|---|---|---|---|---|---|---|
| Blend Ratios for Preparing Base Grease (part by weight) | Calcium Sulfonate 1 | (*1) | 77 | 74 | — | — |
| | Calcium Sulfonate 2 | (*2) | — | — | 42 | 48 |
| | Mineral Oil | (*3) | 19 | 23 | 53 | 46 |
| | 12-Hydroxystearic Acid | | 3 | 2 | 4 | 4 |
| | Azelaic Acid | | 1 | — | — | 2 |
| | Acetic Acid | | — | 1 | 1 | — |
| | Isopropanol | | 2 | 2 | 2 | 2 |
| | Distilled Water | | 5 | 5 | 5 | 5 |
| Properties of Base Grease | Worked Penetration | | 265 | 286 | 275 | 290 |
| | Drop Point | | 260° C. or more | 260° C. or more | 260° C. or more | 260° C. or more |

TABLE 2

| | | | Base Grease 5 | Base Grease 6 |
|---|---|---|---|---|
| Blend Ratios for Preparing Base Grease (part by weight) | Mineral Oil | (*3) | 77.2 | 89.8 |
| | 12-Hydroxystearic Acid | | 13.5 | — |
| | Azelaic Acid | | 5 | — |
| | Lithium Hydroxide Monohydrate | | 4.3 | — |
| | Diphenylmethane-4,4'-Diisocyanate | | — | 5.1 |
| | Octylamine | | — | 5.1 |
| | Water | | 20 | — |
| Properties of Base Grease | Worked Penetration | | 275 | 278 |
| | Drop Point | | 260° C. or more | 260° C. or more |

*1) calcium sulfonate with a base number of 400 mgKOH/g
*2) calcium sulfonate with a base number of 500 mgKOH/g
*3) paraffin mineral oil with a kinematic viscosity at 40 degrees C. of 90 $mm^2/S$ Incidentally, the properties of each base grease were measured according to the following methods.

Evaluation results of each base grease are shown in Tables 1 and 2.

(1) Worked Penetration

Worked penetration was measured according to JIS K 2220.7.

(2) Drop Point

A drop point was measured by a testing method according to JIS K 2220.8.

Preparation of Grease Composition

One of the prepared base greases 1 to 6 was mixed with an aminic antioxidant and a calcium sulfonate with a base number of 400 mgKOH/g at ratios with reference to the total amount of the composition shown in Table 3 to prepare a grease composition.

TABLE 3

| | | | Ex. 1 | | | | Ex. 2 | | | | Ex. 3 | | | | Ex. 4 | | | |
|---|---|---|---|---|---|---|---|---|---|---|---|---|---|---|---|---|---|---|
| Blend Ratios for Preparing Composition Grease (parts by weight) | Base Grease 1 | | 100 | | | | — | | | | — | | | | — | | | |
| | Base Grease 2 | | — | | | | 100 | | | | — | | | | — | | | |
| | Base Grease 3 | | — | | | | — | | | | 100 | | | | — | | | |
| | Base Grease 4 | | — | | | | — | | | | — | | | | 100 | | | |
| | Aminic Antioxidant | (*4) | 2 | | | | 2 | | | | 2 | | | | 2 | | | |
| | Overbased Calcium Sulfonate | (*1) | 5 | | | | 3 | | | | 3 | | | | — | | | |
| | Overbased Calcium Sulonate | (*2) | — | | | | — | | | | — | | | | 1 | | | |
| | Total | | 107 | | | | 105 | | | | 105 | | | | 103 | | | |
| Items for Evaluating Grease Composition | Time for Heating at 175° C. | | 0 | 240 | 480 | 720 | 0 | 240 | 480 | 720 | 0 | 240 | 480 | 720 | 0 | 240 | 480 | 720 |
| | Acid Number | | 4.8 | 5.6 | 6.9 | 7.2 | 4.4 | 5.2 | 5.9 | 6.2 | 5.1 | 6.1 | 5.5 | 6.7 | 5.8 | 6.1 | 6.4 | 6.9 |
| | Base Number | | 164 | 48 | 21 | 12 | 147 | 37 | 23 | 11 | 176 | 71 | 55 | 21 | 101 | 87 | 54 | 18 |
| | Worked Penetration | | 271 | 288 | 268 | 262 | 290 | — | 285 | 277 | 285 | — | 274 | 276 | 288 | 294 | 278 | 268 |

TABLE 4

| | | | Comp. 1 | | | | Comp. 2 | | | | Comp. 3 | | | | Comp. 4 | | | |
|---|---|---|---|---|---|---|---|---|---|---|---|---|---|---|---|---|---|---|
| Blend Ratios for Preparing Composition Grease (parts by weight) | Base Grease 1 | | 100 | | | | — | | | | — | | | | — | | | |
| | Base Grease 2 | | — | | | | — | | | | — | | | | — | | | |
| | Base Grease 3 | | — | | | | — | | | | — | | | | — | | | |
| | Base Grease 4 | | — | | | | 100 | | | | — | | | | — | | | |
| | Base Grease 5 | | — | | | | — | | | | 100 | | | | — | | | |
| | Base Grease 6 | | — | | | | — | | | | — | | | | 100 | | | |
| | Aminic Antioxidant | (*4) | 2 | | | | 2 | | | | 2 | | | | 2 | | | |
| | Overbased Calcium Sulfonate | (*1) | — | | | | — | | | | 1 | | | | 1 | | | |
| | Overbased Calcium Sulfonate | (*2) | — | | | | — | | | | — | | | | — | | | |
| | Total | | 102 | | | | 102 | | | | 103 | | | | 103 | | | |
| Items for Evaluating Grease Composition | Time for Heating at 175° C. | | 0 | 240 | 480 | 720 | 0 | 240 | 480 | 720 | 0 | 120 | — | — | 0 | 120 | — | — |
| | Acid Number | | 4.5 | 6.9 | — | — | 5.7 | 7.6 | — | — | — | — | — | — | — | — | — | — |
| | Base Number | | 132 | 21 | — | — | 79.1 | 10.4 | — | — | — | — | — | — | — | — | — | — |
| | Worked Penetration | | 265 | 215 | too hard to measure | | 290 | 225 | too hard to measure | | 275 | became solid to be unmeasureable | | | 278 | became solid to be unmeasureable | | |

*1) calcium sulfonate with a base number of 400 mgKOH/g

*2) calcium sulfonate with a base number of 500 mgKOH/g

*4) aminic antioxidant (4,4'-diisononyl diphenylamine)

The properties of each grease composition were measured according to the following methods. Evaluation results of each grease composition are shown in Table 5 as well as Tables 3 and 4.

Evaluation Methods

Each of the grease compositions of Examples 1 to 4 and Comparatives 1 to 4 was left in a constant temperature bath set at 175 degrees C. for a predetermined duration of time and taken out of the constant temperature bath to be evaluated in terms of physical properties.

(1) Worked Penetration

Worked penetration was measured according to JIS K 2220.7.

(2) Acid Number

Acid Number was measured according to JIS K 2501.

(3) Base Number

Base Number was measured according to JIS K 2501.

(4) Friction Property (Friction Coefficient)

The grease compositions of Example 4 and Comparatives 2 to 4 were subjected to measurement immediately after prepared (in an unused state). The grease compositions of Example 4 and Comparatives 2 to 4 were subjected to measurement after left in a constant temperature bath set at 175 degrees C. for 480 hours.

Using a ball-on-disc reciprocating sliding friction tester (SRV type, manufactured by Optimal Lubrication), a friction coefficient was measured under conditions of load: 50 N, frequency: 50 Hz, temperature: room temperature, sliding speed: 30 $mm^2/s$, stroke: 1 mm and measurement time: 60 minutes. The ball was made of 52100Steel and has HRC of 60±2, Ra of 0.025±0.005 μm and a diameter of 10 mm. The disc was made of 52100Steel and has a diameter of 24 mm, a thickness of 7.85 mm, HRC of 60±2 and Rz =0.5 μm.

As is evident from Tables 3 and 4, it has been found that the grease compositions of Examples 1 to 4 according to the invention, each of which was prepared by blending the base grease with the aminic antioxidant and the overbased calcium sulfonate, underwent almost no variation in worked penetration and remained in the form of grease even after being subjected to a temperature of 175 degrees C. for 720 hours. Further, as compared with Comparatives 1 and 2, an increase in the acid number is small.

In contrast, the grease compositions of Comparatives 1 and 2, each of which was prepared by blending the base grease solely with the aminic antioxidant, became too hard to measure the worked penetration thereof after being subjected to a temperature of 175 degrees C. for a long duration of time. Further, since the acid number was considerably increased, it has been found that oxidation progressed. The grease compositions of Comparatives 3 and 4, each of which was prepared with a base grease different from the calcium sulfonate complex grease, became a solid after being subjected to a temperature of 175 degrees C. for a long duration of time, so that the worked penetration thereof could not be measured.

TABLE 5

| | Deterioration Conditions | Friction Coefficient |
|---|---|---|
| Ex. 4 | Unused | 0.097 |
| | 175° C. × 480 hr | 0.098 |
| Comp. 2 | Unused | 0.10 |
| | 175° C. × 480 hr | Galling |
| Comp. 3 | Unused | 0.11 |
| | 175° C. × 480 hr | Galling |
| Comp. 4 | Unused | 0.10 |
| | 175° C. v 480 hr | Galling |

As is evident from Table 5, it has been found that the grease composition of Example 4 according to the invention, which was prepared by blending the calcium sulfonate complex grease (base grease) with the aminic antioxidant and the overbased calcium sulfonate (additive), maintained an excellent lubricity irrespective of whether the grease composition was in an unused state or was heated at 175 degrees C. for 480 hours.

In contrast, it has been found that the grease composition of Comparative 2, which was prepared by blending the calcium sulfonate complex grease (base grease) solely with the aminic antioxidant (additive), and the grease compositions of Comparatives 3 and 4, each of which was prepared with a base grease different from the calcium sulfonate complex grease, exhibited an excellent lubricity in an unused state, but became harder after being heated at 175 degrees C. for 480 hours and caused galling due to a poor lubricity thereof.

The invention claimed is:

1. A grease composition, comprising:

no more than one thickener, wherein the thickener consists of a calcium sulfonate complex thickener comprising calcium sulfonate, calcium carbonate, and at least two calcium salts selected from the group consisting of calcium dibehenate, calcium distearate, calcium dihydroxystearate, calcium borate, and calcium acetate;

a base oil; and an additive comprising an overbased metal sulfonate and an aminic antioxidant, wherein the calcium sulfonate complex thickener is present in an amount of more than 40% to 76% by mass, based on a total amount of the grease composition.

2. The grease composition according to claim 1, wherein the overbased metal sulfonate is an overbased alkaline earth metal sulfonate.

3. The grease composition according to claim 1, wherein the overbased metal sulfonate is an overbased calcium sulfonate.

4. The grease composition according to claim 1, wherein a content of the overbased metal sulfonate and the aminic antioxidant is in a range from 0.2 mass % to 20 mass % of a total amount of the grease composition.

5. The grease composition according to claim 1, wherein the overbased metal sulfonate has a base number of 100 mgKOH/g or more.

6. The grease composition according to claim 1, wherein the base oil is a mineral oil with a kinematic viscosity at 40 degrees C. of 60 $mm^2/s$ or more.

7. The grease composition according to claim 1, wherein the grease composition has a worked penetration in a range from 220 to 385.

8. The grease composition according to claim 1, wherein the calcium sulfonate complex thickener comprises the calcium dibehenate, the calcium distearate, or the calcium dihydroxystearate as one of the at least two calcium salts.

9. The grease composition according to claim 1, wherein the calcium sulfonate complex thickener comprises the calcium acetate as one of the at least two calcium salts.

10. The grease composition according to claim 1, comprising, based on a total amount of the grease composition:

from more than 40 mass % to 60 mass % of the calcium sulfonate complex thickener;

from 1 mass % to 5 mass % of the overbased metal sulfonate;

from 1 mass % to 5 mass % of the aminic antioxidant.

11. The grease composition according to claim 1, wherein the overbased metal sulfonate is present in an amount of more than 1% to 10% by mass, based on a total amount of the grease composition.

12. The grease composition according to claim 1, wherein the calcium sulfonate complex thickener is present in an amount of 45 to 76% by mass, based on a total amount of the grease composition.

* * * * *